US005994695A

United States Patent [19]

Young

[11] Patent Number: 5,994,695

[45] Date of Patent: Nov. 30, 1999

[54] OPTICAL PATH DEVICES FOR MASS SPECTROMETRY

[75] Inventor: James E. Young, La Honda, Calif.

[73] Assignee: Hewlett-Packard Company, Palo Alto, Calif.

[21] Appl. No.: 09/087,787

[22] Filed: May 29, 1998

[51] Int. Cl.[6] ..... H01J 49/40

[52] U.S. Cl. ..... 250/287; 250/396 R

[58] Field of Search ..... 250/287, 396 R

[56] References Cited

U.S. PATENT DOCUMENTS

| | | | |
|---|---|---|---|
| 4,731,532 | 3/1988 | Frey et al. | 250/287 |
| 5,166,521 | 11/1992 | Hayashi et al. | 250/309 |
| 5,300,774 | 4/1994 | Buttrill, Jr. | 250/287 |
| 5,331,158 | 7/1994 | Dowell | 250/287 |
| 5,834,771 | 11/1998 | Yoon et al. | 250/287 |

*Primary Examiner*—Kiet T. Nguyen

[57] ABSTRACT

An apparatus, system and method of fabricating the apparatus utilize a flexible substrate to provide structural integrity for the apparatus. The apparatus is an optical path device used in mass spectrometers to manipulate ions extracted from a sample of interest. The apparatus uses traces on a surface of the flexible substrate to generate a desired electrostatic field. Preferably, the flexible substrate is made of KAPTON® and the traces are composed of stainless steel or nickel. In one embodiment, an ion mirror is formed by shaping the flexible substrate and the traces to create a hollow conduit for the ions. In another embodiment, an einzel lens is formed by varying the configuration of the conductive material on the flexible substrate. In a different embodiment, a region of resistive material on the flexible substrate is utilized to create a field gradient. The resistive material can be used to create an ion mirror.

22 Claims, 7 Drawing Sheets

OPTICAL PATH DEVICES FOR MASS SPECTROMETRY

TECHNICAL FIELD

The invention relates generally to mass spectrometers and more particularly to optical path devices utilized in mass spectrometers.

DESCRIPTION OF THE RELATED ART

Ions which have the same initial kinetic energy but different masses will separate when allowed to drift down a field free region. This is the basic principle of typical time-of-flight mass spectrometers. Ions are extracted from an ion source in small packets. The ions acquire different velocities according to the mass-to-charge ratio of the ions. Low-mass ions will arrive at a detector prior to high-mass ions. Determining the flight times of the ions across a propagation path permits the calculation of the masses of different ions. The propagation path may be circular or helical, as in cyclotron resonance spectrometry, but typically linear propagation paths are used for chromatography mass spectrometry application. Such time-of-flight mass spectrometers are used in forensic analysis, drug testing, pharmaceutical analysis, and other analytical applications.

Time-of-flight mass spectrometry is used to form a mass spectrum of ionized particles extracted from a sample of interest. Two common methods utilized to ionize particles of a sample are inductively coupled plasma mass spectrometry (ICP-MS) and gas chromatography mass spectrometry (GC-MS). In ICP-MS, a sample is ionized by an ion stream provided by a plasma generator. In GC-MS, a gas to be analyzed is ionized by a filament in a mass spectrometer. After the ionization, a pulse of high voltage is applied to a pulser to propel a packet of ions to a detector. The resolution of a mass spectrum produced by a time-of-flight mass spectrometer is affected by the width of the packet of ions and the differences in initial kinetic energies of the ions having same masses within the packet. To improve the resolution of time-of-flight mass spectrum, an einzel lens can be used to focus the ions within packets, while one or more ion mirrors can be used to increase the length of the flight path for a given area. Both devices utilize electrostatic fields to manipulate the ions during flight in order to achieve their goals.

In FIG. 1, a top view of a conventional inductively coupled plasma time-of-flight mass spectrometer 10 having a pulser 12, an einzel lens 14, two ion mirrors 16, a detector 18, and a plasma generator 20 is shown. Typically, the conventional time-of-flight mass spectrometer 10, excluding the plasma generator 20, is placed in a vacuum to eliminate any potential interference from particles present in the air. The dotted lines represent flight paths 22, 24 and 26 of an ion packet. The pulser 12 includes a pulse plate 28 and a pulser exit plate 30. The pulse plate 28 is a solid plate. The pulser exit plate 30 has an aperture allowing a packet of ions to traverse from within the pulser to the first ion mirror 16. The aperture may be circular or rectangular. The pulse plate 28 and the pulser exit plate 30 can be made of stainless steel.

The two ion mirrors 16 are shown to include mirror plates 32, a wire-mesh grid 33 and a mirror back plate 34. Only four mirror plates 32 are shown in order to simplify FIG. 1. In actuality, the ion mirrors 16 may have more than four mirror plates 32. Other alternative designs for the ion mirrors 16 are possible with additional wire-mesh grids. Similar to the plates 28 and 30 of the pulser 12, the mirror back plate 34 is a solid plate while the mirror plates 32 have apertures to provide a conduit for a packet of ions. Again, the apertures in the mirror plates 32 may be circular or rectangular.

Positioned between the pulser 12 and the first ion mirror 16 is the einzel lens 14. The einzel lens 14 includes three focus plates 36 having circular or rectangular apertures. The einzel lens 14 further includes two parallel horizontal plates 38 and two parallel vertical plates 40 (only one vertical plate 40 is shown). The horizontal and vertical plates 38 and 40 are known as steering plates. The plates 32 and 34 of the ion mirrors and the plates 36, 38 and 40 of the einzel lens 14 can all be made of stainless steel.

In operation, a sample of interest is introduced into the pulser 12. The plasma generator 20 emits a plasma beam to extract ions from the sample of interest. A pulse of high voltage is applied to the pulse plate 28 to propel the extracted ions in a packet. The packet of ions propagate through the pulser exit plate 30 and the einzel lens 14. As the packet of ions travels through the einzel lens 14, the width of the ion packet is focused by the einzel lens 14. This is accomplished by generating an electrical field within the einzel lens 14 by means of applying selected voltages to the focus plates 36, the horizontal plates 38 and the vertical plates 40.

After the packet of ions is focused, the packet travels to the first ion mirror 16, which is located at the end of the flight path 22. The packet of ions entering the first ion mirror 16 is redirected almost 180 degrees towards a second ion mirror 16 along the flight path 24. Similar to the einzel lens 14, selected voltages are applied to the mirror plates 32 and the wire-mesh grid 33 to create an electrical field gradient within the ion mirror 16 to decelerate the packet entering the first ion mirror along the flight path 22. The same electrical field gradient then accelerates the packet of ions along the flight path 24, after the packet has changed the direction of the flight path from the flight path 22 to the flight path 24. Along the flight path 24, the second ion mirror 16 receives the packet of ions and manipulates the packet of ions in the same manner as the first ion mirror 16. The second mirror 16 redirects the packet of ions to the detector 18 along the flight path 26. The ion mirrors 16 compensate for differences in initial kinetic energies of same massed ions in the packet by allowing more energetic ions to traverse further into the ion mirrors 16, thereby spending greater time in the ion mirrors 16. The ion mirrors 16 operate to manipulate the ions in the packet such that the ions with equal masses arrive at the detector 18 at approximately the same time.

After propagating through the two ion mirrors 16, the packet of ions arrives at the detector 18. By calculating the times of flight required to travel from the pulser 12 to the detector 18 along flight paths 22, 24 and 26, the masses of the ions in the packet can be determined and the determinations can be used in an analysis of the sample from which the packet was acquired.

FIG. 2 is a perspective view of a conventional ion mirror 44 that has been partially cut away. The ion mirror 44 is the same type of device as the ion mirrors 16 in FIG. 1. Identical to the ion mirrors 16, the ion mirror 44 has a mirror back plate 34 and a wire-mesh grid 33. However, the ion mirror 44 is shown to contain five mirror plates 32. The mirror plates 32 have rectangular apertures to serve as conduits for passage of packets of ions. The wire-mesh grid 33 is shown to be positioned between two grid frame plates 46. The grid frame plates 46 provide support for the wire-mesh grid 33. Spacers 48 are situated between adjacent mirror plates 32 and between the mirror plates and the grid frames and mirror back plate 34. The spacers 48 provide the correct spacings between the plates 32, 34 and 46, in addition to providing support. The spacers 48 are typically made of ceramic or other non-conductive material in order to prevent conduction between the grid frame plates 46, the mirror plates 32, and the mirror back plate 34. The plates 32, 34 and 46 can be constructed of stainless steel.

Turning to FIG. 3, a conventional einzel lens 50 is shown. The einzel lens 50 is identical to the einzel lens 14 of FIG. 1. However in FIG. 3, both vertical plates 40 are illustrated. Three focus plates 36 having rectangular apertures are positioned between the horizontal plates 38 and vertical plates 40. Spacers 48 are shown positioned between the focus plates 36 and between the vertical plates 40. Again, the spacers 48 are made of ceramic or other non-conductive material. The plates 36, 38 and 40 can be constructed of stainless steel.

A concern with the ion mirror 44 and the einzel lens 50 is that both devices require a substantial amount of stainless steel, or other metal, for construction. The amount of stainless steel required by the devices not only contributes to the overall weight of a mass spectrometer, but also increases the cost to manufacture the mass spectrometer. In addition, the need to create apertures in some of the plates in the ion mirror 44 and the einzel lens 50 presents an obstacle when trying to design smaller ion mirrors and einzel lenses.

While the known optical path devices such as ion mirrors and einzel lenses operate well for their intended purposes, what is needed is a design that allows construction of more cost-efficient, lighter and compact optical path devices.

SUMMARY OF THE INVENTION

An apparatus, system and method of fabricating the apparatus utilize a flex circuit having a flexible substrate to provide structural integrity and having conductive material for establishing a desired electrostatic field within the apparatus. The apparatus is an optical path device that can be used in time-of-flight mass spectrometers to manipulate ions extracted from a sample of interest. However, the optical path device may also be utilized in other types of mass spectrometers. Optical path devices such as ion mirrors and lenses can be constructed using the flexible substrate.

Unlike conventional optical path devices that use metal plates to create electrostatic fields along a propagation path of packets of ions, the present invention uses traces on a surface of the flexible substrate. Preferably, the flexible substrate is made of a polyimide (such as the one sold by E.I. duPont de Nemours and Company under the federally registered trademark KAPTON) or other polymer material. The traces are preferably thin metal traces, and can be composed of stainless steel, nickel, or other metals having similar conductive properties. Depending upon the type of device desired, the flex circuit is configured into long strips and/or rectangular sheets. The flexible substrate along with the traces can be shaped into various geometrical shapes having a hollow conduit for passage of ions.

In one embodiment, an ion mirror is fabricated using the flexible substrate. The flexible substrate forms an ion mirror shell of the ion mirror. The ion mirror shell can be shaped into a rectangular box-like configuration having a rectangular hollow conduit. The geometrical configuration of the ion mirror is not crucial to the invention as long as the desired electrostatic field within the hollow conduit of the ion mirror can be created. Another possible configuration for the ion mirror in accordance with the present invention is a circular tube-like configuration. A number of traces in strips, composed of stainless steel, are affixed to the flexible substrate to form frames around the hollow conduit. Although the traces are composed of stainless steel, other metals having similar conductive properties may be utilized, such as nickel. The number of traces included in the ion mirror can vary depending on the electrostatic field gradient desired in the hollow conduit. Preferably, the traces are affixed to the interior surface of the ion mirror shell. The traces are functionally equivalent to mirror plates of a conventional ion mirror.

The ion mirror also includes a back plate. The back plate is attached to one end of the ion mirror shell, providing a barrier within the hollow conduit. The ion mirror may also include one or more wire-mesh grids. In a one wire-mesh grid ion mirror, a single wire-mesh grid is positioned within the ion mirror shell such that the wire-mesh grid is orientated on a perpendicular plane with respect to the axis of the hollow conduit. Two grid frames position the wire-mesh grid in place within the hollow conduit. The wire-mesh grid along with the grid frames may be electrically coupled to an adjacent trace. Attached to each trace is a fast-on connector, but other means of forming a connection may be used. The fast-on connectors are coupled to a voltage supply to provide various voltages to the traces. The back plate may also be connected to the voltage supply. When particular voltages are applied to the traces, back plate and the wire-mesh grid, a desired electrostatic field gradient is generated within the hollow conduit.

The ion mirror shell assembly can be supported by a brace plate. The brace plate may include a rectangular aperture allowing the ion mirror shell to slip into the aperture of the brace plate. Preferably, one of the traces includes tabs that can be folded and spot welded onto the brace plate. The attachment of the tabs to the brace plate secures the ion mirror shell assembly to the brace plate.

In another embodiment, an einzel lens is fabricated using the flex circuit. The flexible substrate forms a shell of the einzel lens. The einzel lens shell can be configured into a circular tube-like shape having a circular hollow conduit. Similar to the ion mirror embodiment, the geometrical configuration of the einzel lens is not crucial to the invention. A number of circular traces, having the same axis as the hollow conduit, are affixed to the flexible substrate. Similar to the traces of the ion mirror, the traces of the einzel lens can be composed of stainless steel, nickel, or other metals having similar conductive properties. The number of traces included in the einzel lens can vary depending on the electrostatic field desired in the circular hollow conduit. Preferably, the traces are affixed to the interior surface of the einzel lens shell. The circular traces are functionally equivalent to focus plates of a conventional einzel lens.

In addition to circular traces, the einzel lens may include one or more trace sheets. Preferably, the einzel lens includes two pairs of trace sheets. The trace sheets may be in the form of rectangular plates. One pair of sheets is affixed to the interior surface of the einzel lens shell on opposite sides such that the pair of sheets creates a horizontal electrostatic field when voltages are applied to the pair of sheets. The other pair of sheets is affixed to the interior surface of the einzel lens shell on opposite sides such that the pair of sheets creates a vertical electrostatic field when voltages are applied to the pair of sheets. The trace sheets are functionally equivalent to horizontal and vertical plates of a conventional einzel lens.

In the preferred embodiment, the circular traces and the trace sheets are attached to fast-on connectors. The fast-on connectors are coupled to a voltage supply to provide various voltages to the circular traces and the trace sheets in order to generate the desired electrostatic field within the circular hollow conduit of the einzel lens. The einzel lens may also include a brace plate similar to the ion mirror, but with a circular aperture.

The ion mirror and the einzel lens of the present invention both function in the same manner as conventional ion mirrors and einzel lenses. The ion mirror reflects incoming ions by redirecting the ions almost 180 degrees using an electrostatic field gradient. The einzel lens focuses packets of ions by also utilizing an electrostatic field. While conventional optical path devices uses metal plates to create the desired electrostatic field, optical path devices of the present invention employ traces on a flexible substrate to create the same electrostatic field. By using traces of various sizes and shapes, a variety of optical path devices can be constructed.

In another embodiment, an ion mirror is constructed using a continuous coating of resistive material arranged onto the flexible substrate. Instead of having a number of traces to generate the desired electrostatic field gradient within the hollow conduit, as is the case in the embodiment describe above, the ion mirror of this embodiment uses the resistive material to generate the electrostatic field gradient. The resistive material has a greater electrical resistance than the traces. The resistive material may be formed by depositing or silk screening the resistive material onto the flexible substrate. The area of resistive material is electrically coupled to two traces that provide a potential difference across the resistive material. The resistive material provides a desired voltage drop when voltage is applied to the traces. The voltage drop facilitates the generation of the desired electrostatic field gradient within the hollow conduit of the ion mirror.

The resistive material configuration may also be utilized in other optical path devices, such as einzel lenses. In addition, the resistive material configuration may be modified to create non-conventional electrical fields within a hollow conduit of an optical path device. A variety of electrical fields may be generated by configuring a number of resistive material regions of various sizes and shapes onto a surface of an optical path device.

A method of fabricating optical path devices in accordance with the invention includes configuring resistive material and/or conductive traces into desired shapes, depending on the type of optical path device being constructed. For example, a coating of metal may be selectively etched to define the desired pattern. In another embodiment, the trace material and the resistive material are photolithographically deposited onto the flexible substrate. After the resistive material and/or traces are formed to the flexible substrate, the flexible substrate along with the resistive material and/or traces are shaped into a desired geometrical form. For example, the flex circuit can be shaped into a circular tube-like configuration. Alternatively, the flexible substrate can be shaped into a rectangular box-like shape, such that a rectangular hollow conduit is created with the flexible substrate. After the flexible substrate along with the resistive material and/or traces are shaped, the shaped component can be mounted onto a mass spectrometer.

An advantage of the present invention is that a minimal amount of metallic material is needed to construct an optical path device, because conventional metal plates are substituted with traces configured onto a flexible substrate. The minimal use of metallic material equates to a lighter and more compact optical path device.

Another advantage is that the use of a flex circuit allows for easier construction of optical path devices than the metal plates used in conventional optical path devices. In addition, the non-conductive flexible substrate eliminates the need for spacers between traces, since the flexible substrate serves as electrical insulation between the traces.

Still another advantage of the present invention is that one or more optical path devices and other components of a time-of-flight mass spectrometer may be incorporated into a single structure formed by one piece of the flex circuit.

DETAILED DESCRIPTION

Figure 4:
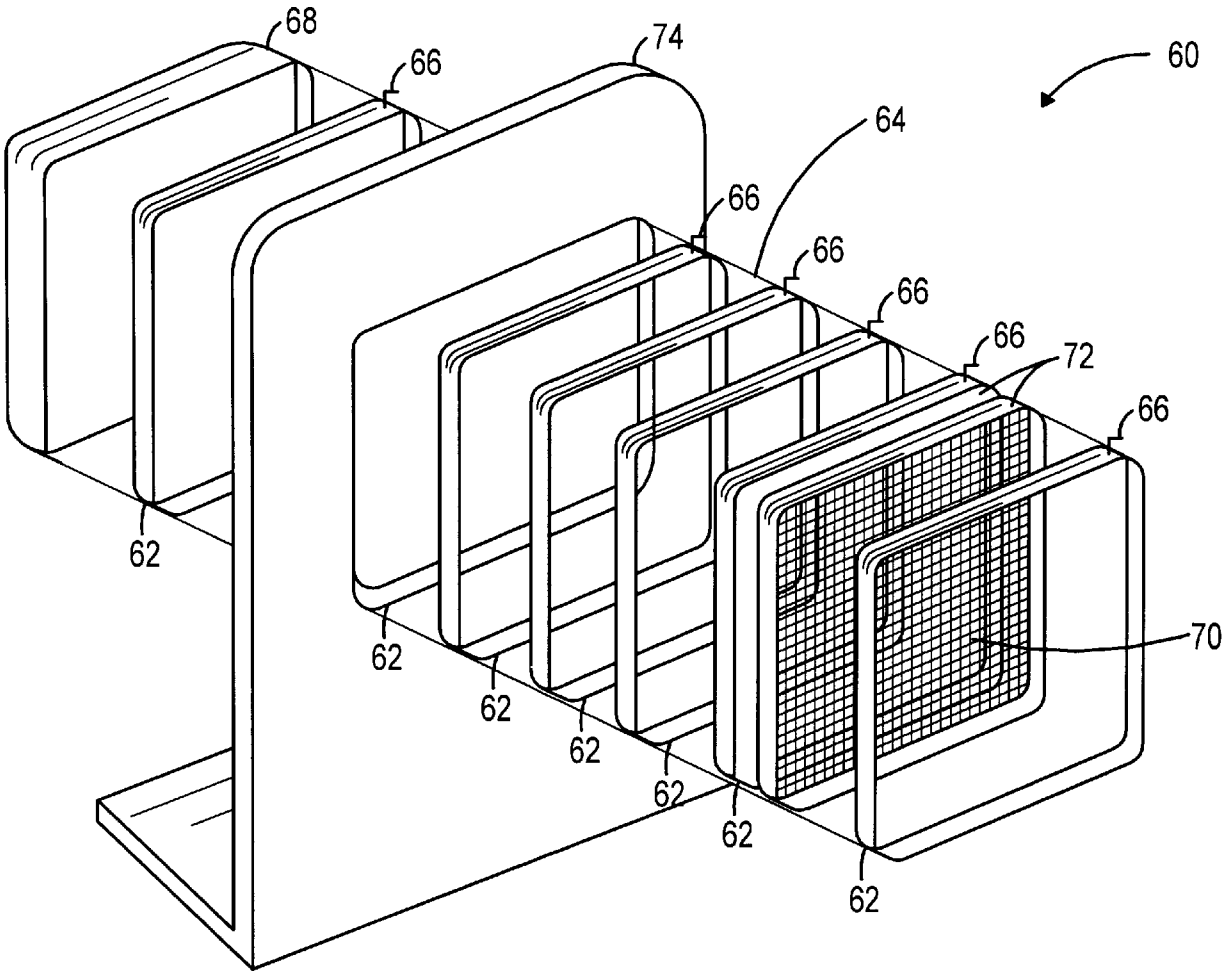
FIG. 4 is a perspective view of an ion mirror in accordance with the present invention.

In FIG. 4, an ion mirror 60 in accordance with the present invention is shown. Seven traces 62 having rectangular frame-like configurations are positioned in a sequential manner. The number of traces 62 is not critical to the invention. The traces 62 are made of stainless steel material. However, the traces 62 can be fabricated with other metals having similar conductive characteristics, such as nickel. Preferably, the traces 62 have sufficient rigidity so that the traces 62 are able to maintain their rectangular shape. In the preferred embodiment, the traces 62 are covered by an ion mirror shell 64, such that the traces 62 are affixed to the interior surface of the ion mirror shell 64. The ion mirror shell 64 is illustrated in a transparent form in order to highlight the traces 62. The ion mirror shell 64 is composed of polymer material, such as polyimide. Preferably, non-conductive KAPTON® is used to form the ion mirror shell 64. However, other polymer materials can be utilized to create the ion mirror shell 64. The traces 62 are electrically insulated from each other by the ion mirror shell 64. The ion mirror shell 64 along with the traces 62 create a hollow conduit for passage of ion packets.

Figure 2:
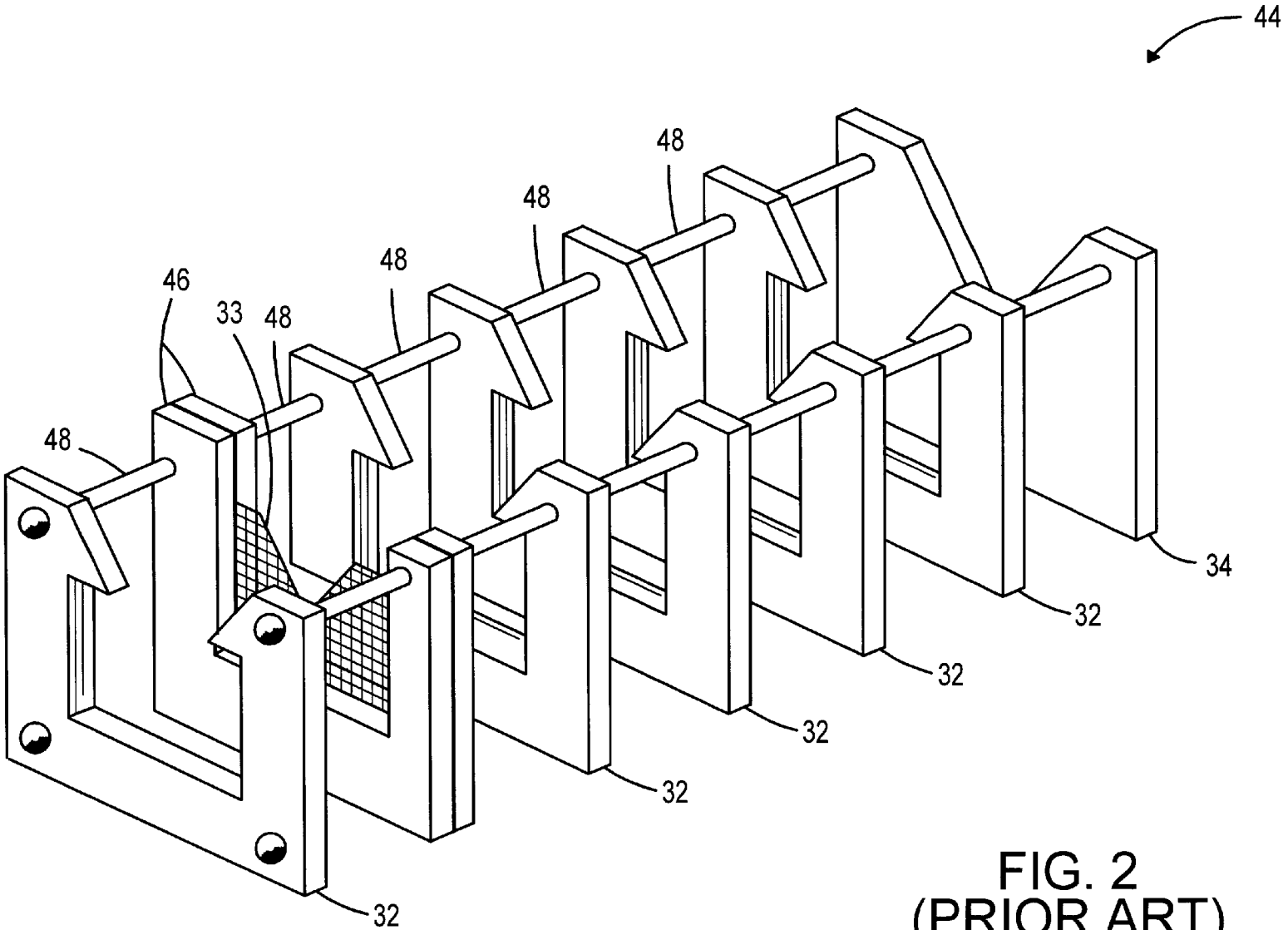
FIG. 2 (PRIOR ART)
FIG. 2 is a perspective view of a conventional ion mirror that has been partially cut away.

Situated on top of each trace 62 are L-shaped fast-on connectors 66 (only six are illustrated). The fast-on connectors 66 are attached to the traces 62 through the ion mirror shell 64 in order to provide voltages to the traces 62 when voltages are applied to the fast-on connectors 66. The traces 62 of the ion mirror 60 are functionally equivalent to the mirror plates 32 of the ion mirror 44 in FIG. 2. Similarly, a back plate 68, located at the end of the ion mirror 60, is functionally equivalent to the mirror back plate 34 of the ion mirror 16. Preferably, the back plate 68 is designed to attach to the ion mirror shell 64 by fasteners, e.g. clips. A conventional wire-mesh grid 70 is positioned within the rectangular hollow conduit created by the ion mirror shell 64. The wire-mesh grid 70 is supported by two grid frames 72. The grid frames 72 are similarly shaped as the traces 62 to fit into the rectangular hollow conduit. The wire-mesh grid 70 and the grid frames 72 may be electrically coupled to an adjacent trace 62.

The ion mirror shell 64 is supported by a brace plate 74. The brace plate 74 is designed to be attached to a mass spectrometer. The brace plate 74 has a rectangular aperture to hold the ion mirror shell 64. Preferably, the brace plate 74 is soldered to one of the traces 62 that is positioned in the aperture of the brace plate 74. The connection between the brace plate 74 and the trace 62 will be described in detail with reference to FIG. 5.

Figure 1:
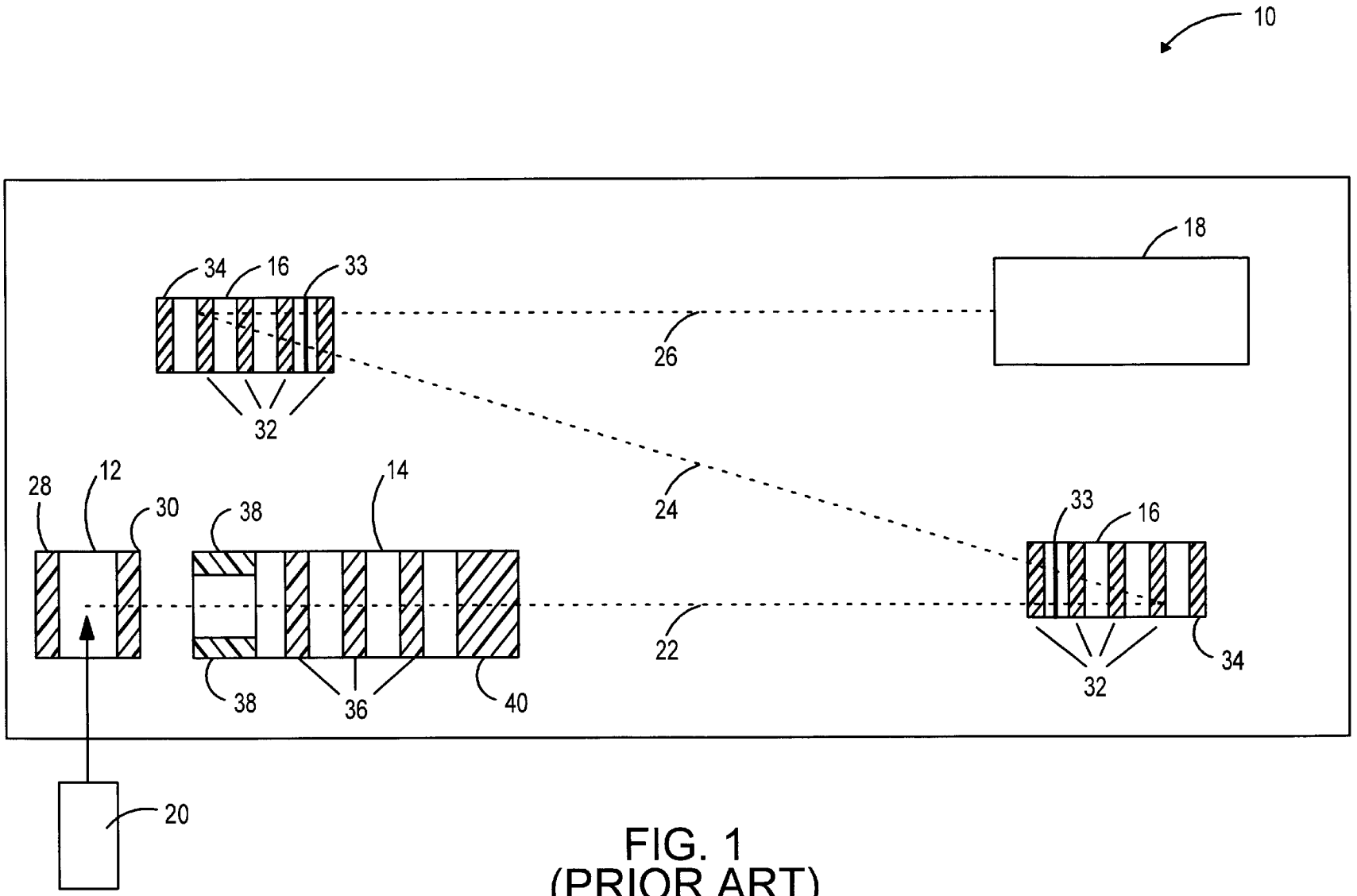
FIG. 1 (PRIOR ART)
FIG. 1 is an illustration of a top view of a conventional time-of-flight mass spectrometer.

The ion mirror 60 operates in an identical manner as the ion mirrors 16 in FIG. 1. Signals of varying voltage are applied to the traces 62 through the fast-on connectors 66. A separate voltage may be applied to the wire-mesh grid 70. If the wire-mesh grid 70 is electrically coupled to the adjacent trace 62, the separate voltage is not required. A voltage may also be applied to the back plate 68. The voltages on the traces 62, the wire-mesh grid 70, and the back plate 68 generate an electrostatic field gradient within the hollow conduit of the ion mirror 60. A packet of ions enters the ion mirror 60 through the aperture of the ion mirror 60 and traverses toward the back plate 68. The electrostatic field gradient within the hollow conduit decelerates the ions as they approach the back plate 68. The electrostatic field gradient eventually redirects the ions almost 180 degrees and accelerates the ions away from the back plate 68. The ion mirror 60 can be positioned within a mass spectrometer, such that the packet of ions entering the ion mirror 60 is redirected toward another ion mirror or a detector.

Although the ion mirror 60 has a rectangular box-like shape, other geometrical shapes can also be utilized. For example, the ion mirror shell 64 could be configured into a circular tube-like shape. In this embodiment, the hollow conduit of the ion mirror 60 is circular. The back plate 68 can also be circular to fit into the circular conduit. The wire-mesh grid 70 and the grid frames 72 can be circular as well. However, the operation of a circular ion mirror 60 would be identical to the rectangular ion mirror 60. The geometrical configuration of the ion mirror 60 is not critical to the invention, as long as the desired electrostatic field gradient within the hollow conduit of the ion mirror 60 can be generated.

Figure 5:
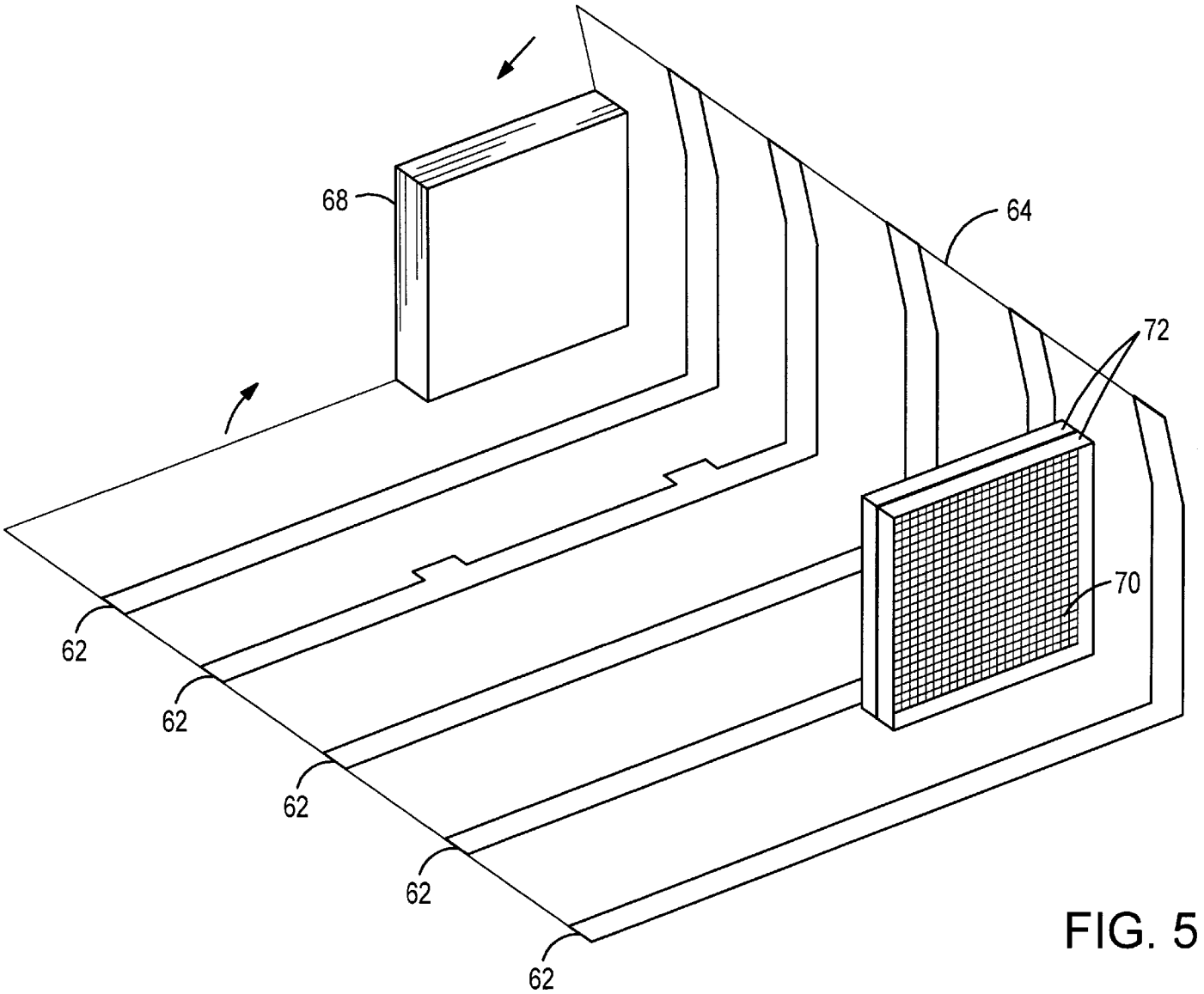
FIG. 5 is an illustration of the ion mirror in accordance with the present invention that is in the process of being shaped into a desired geometrical form.

FIG. 5 is an illustration of the ion mirror 60 that is in the process of being shaped into a desired geometrical form, i.e. rectangular box-like configuration. The back plate 68 and the wire-mesh grid 70 with the grid frames 72 are positioned to conform to the hollow conduit of the ion mirror shell 64 when shaped. Initially, traces 62 are deposited or etched onto a flexible substrate, such as KAPTON®. The traces 62 are configured in long strips on the ion mirror shell 64. The long strips will contour into the rectangular frame-like structures when the ion mirror shell 64 is folded around the back plate 68 and the grid frames 72. The second trace 62 from the far left includes two tabs 76. The tabs 76 are part of that trace 62. The tabs 76 can be folded out and soldered to the brace plate 74. In other words, the tabs 76 can be folded away from the hollow conduit created by the ion mirror shell 64 when shaped. The ion mirror shell 64 includes two holes to allow the tabs 76 to be folded out through the ion mirror shell 64.

After the ion mirror shell 64 is folded into the rectangular box-like shape, the traces 62 can be soldered to hold each trace 62 in the rectangular frame-like configuration. Preferably, the traces 62 will slightly overlap when folded. The back plate 68 may be glued to the ion mirror shell 64. The back plate 68 may include clips to secure the back plate 68 onto the ion mirror shell 64. The grid frames 72 can also be glued to the ion mirror shell 64. Alternatively, the grid frames 72 can be soldered to the adjacent trace 62. The adjacent trace 62 can be configured to form tabs (not shown) similar to the tabs 76 in order provide an area to solder the adjacent trace 62 to the grid frames 72. The wire-mesh grid 70 is positioned in place by the grid frames 72.

An ion mirror having a circular tube-like structure can also be formed using similar methods as described above. In this embodiment, the back plate 68, the grid frames 72, and the wire-mesh grid 70 will have circular shapes instead of the rectangular shapes shown in FIG. 5. The ion mirror shell 64 can then be rolled into the circular tube-like shape. The soldering of traces 62 can be accomplished in the same manner as described previously. The back plate 68 and the grid frames 72 can also be affixed to the ion mirror shell 64 in the manner as described above.

Figure 6:
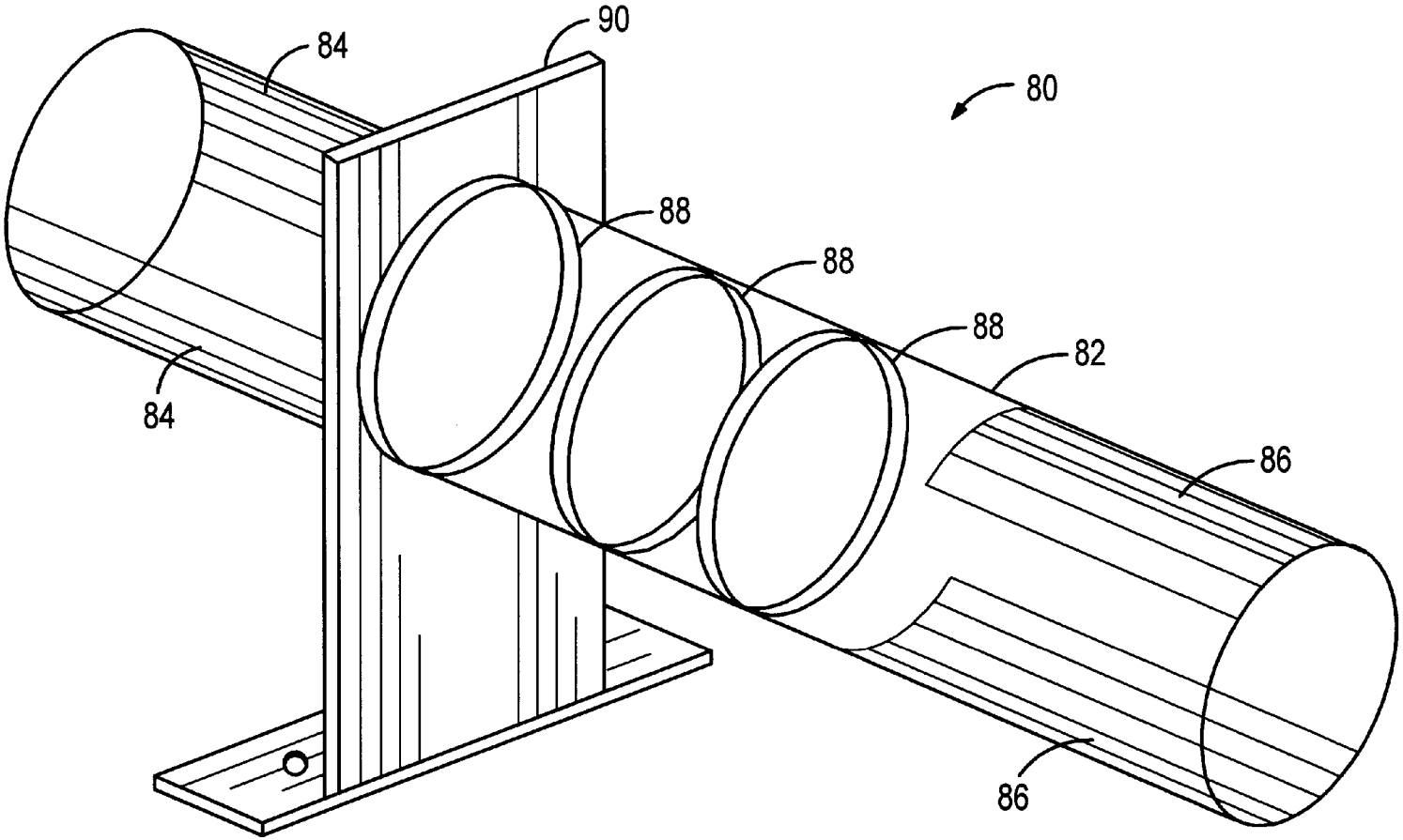
FIG. 6 is a perspective view of an einzel lens in accordance with the present invention.

Using a similar design as the ion mirror 60, other optical path devices can be constructed. In FIG. 6, an einzel lens 80 in accordance with the present invention is shown. A lens shell 82 defines the shape of the einzel lens 80. The lens shell 82 has a circular tube-like shape. The shape of the lens shell 82 provides a circular conduit through the einzel lens 80. The hollow conduit is designed to accommodate a propagation path of a packet of ions through the einzel lens 80 in a time-of-flight mass spectrometer. Identical to the ion mirror shell 64, the lens shell 82 can be composed of a polymer material, preferably KAPTON®.

Formed on the surface of the lens shell 82 are two lateral traces 84, upper and lower traces 86, and three focus traces 88. The lateral, upper, and lower vertical traces 84 and 86 are rectangular sheets that have been contoured to fit onto the curved surface of the lens shell 82. Similar to the traces 62 of the ion mirror 60, the traces 84, 86 and 88 can be made of stainless steel, nickel, or other metal having similar conductive characteristics. Preferably, the traces 84, 86 and 88 are affixed to the interior surface of the lens shell 82. A brace plate 90 is attached to the lens shell 82. The brace plate 90 is designed to be attached to a mass spectrometer. Although not shown in FIG. 6, fast-on connectors can be attached to each of the traces 84, 86 and 88 to provide voltages of varying degrees.

Figure 3:
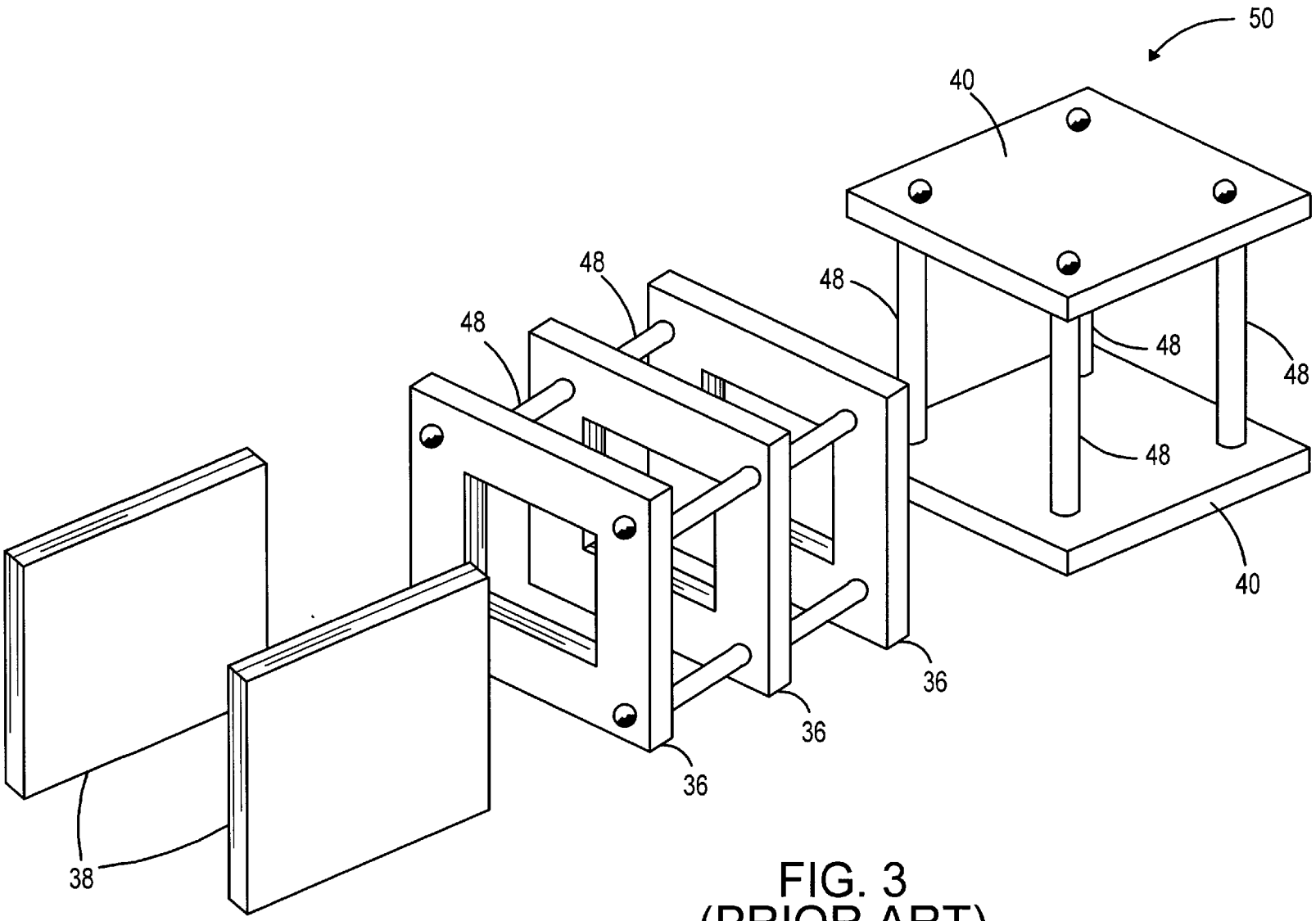
FIG. 3 (PRIOR ART)
FIG. 3 is a perspective view of a conventional einzel lens.

In operation, the einzel lens 80 functions in an identical manner as the conventional einzel lens 50 in FIG. 3. Initially, voltages are applied to the traces 84, 86 and 88, thereby creating an electrical field within the circular conduit of the einzel lens 80. A packet of ions enters the input aperture, the left open end of the circular conduit created by the lens shell 82. The electrical field created by the lateral traces 84, the upper and lower traces 86, and the focus traces 88 induces the ions to form a narrower packet. The effects of such an electrical field on moving ions are well known to persons skilled in the art. The narrowed packet of ions exits through the output aperture, the right open end of the circular conduit, and then travels to another optical path element, such as an ion mirror, or to a detector.

The einzel lens 80 shown in FIG. 6 could be configured into another geometrical shape. In an alternative embodiment, the einzel lens 80 has the same rectangular box-like shape as the ion mirror 60. The only modifications needed to construct the rectangular einzel lens 80 are to configure the lens shell 82 along with the traces 84, 86 and 88 into a rectangular box-like shape.

Utilizing the configuration of the einzel lens 80, an entire non-reflecting linear time-of-flight mass spectrometer may be constructed. By increasing the length of the lens shell 82, a pulser and a detector can be placed in the lens shell 82, creating an integrated linear time-of-flight mass spectrometer. A circular pulse plate and a circular pulse exit plate can be attached to the lens shell 82 to the left of the horizontal traces 84. The detector can be placed to the right of the vertical traces 86. Other designs of an integrated linear time-of-flight mass spectrometer are also possible using similar configurations. For example, an integrated linear time-of-flight mass spectrometer having two einzel lenses may be constructed.

Figure 7:
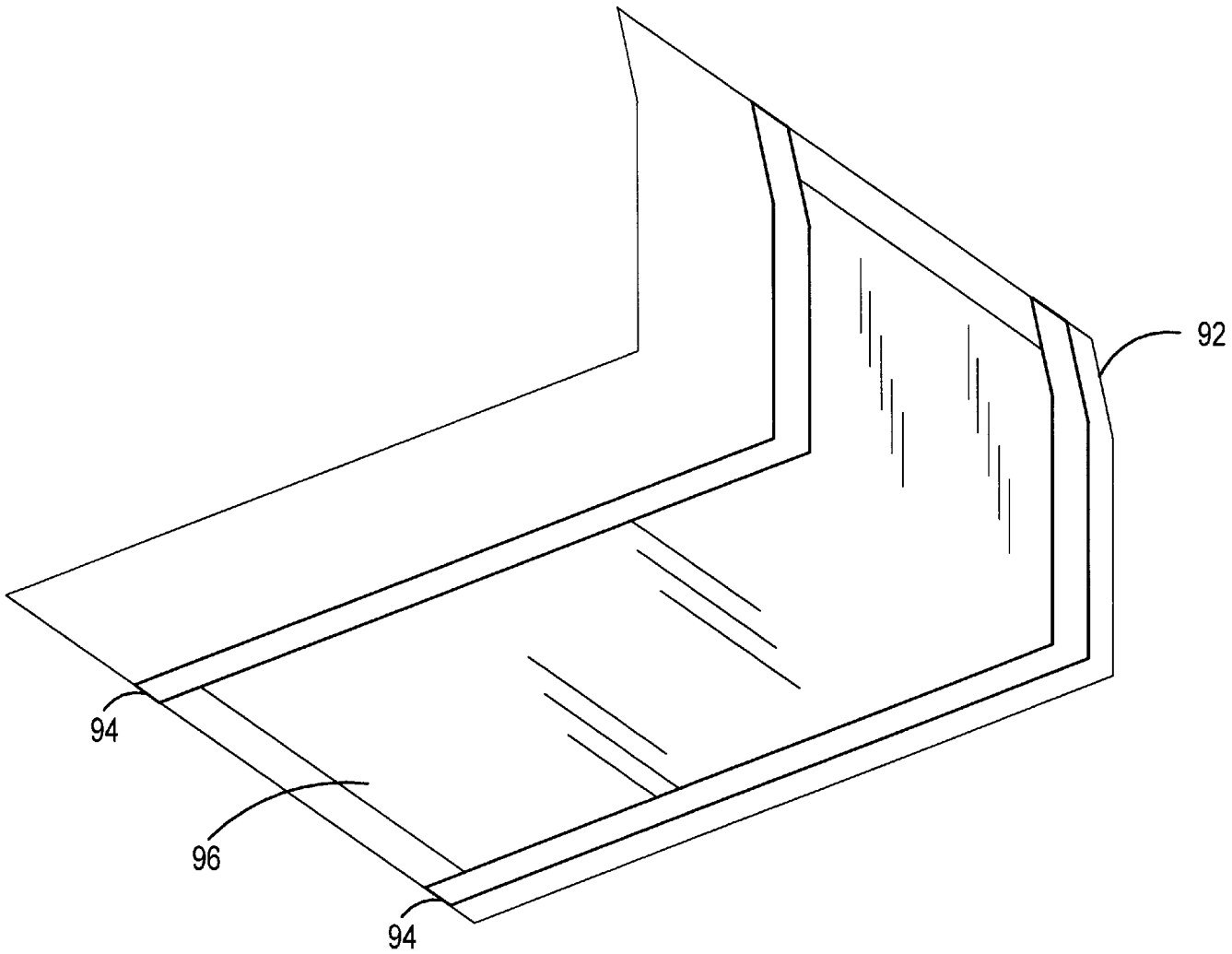
FIG. 7 is an illustration of an ion mirror in accordance with another embodiment of the present invention that is in the process of being shaped into a desired geometrical form.

In another embodiment, resistive material is used to create an electrostatic field gradient within an optical path device. FIG. 7 shows an ion mirror shell 92 having two traces 94 at opposite ends of an area of resistive material 96. The traces 94 can be identical to the traces 62 of the ion mirror 60 in FIG. 5. The area of resistive material 96 may be formed by depositing or silk screening the resistive material onto the ion mirror shell 92. Alternatively, the area of resistive material 96 may be formed prior to being affixed to the ion mirror shell 92. Preferably, the resistive material 96 has a higher electrical resistance that the traces 94 to provide a uniform voltage drop across the area of resistive material 96 when a potential difference is formed across the traces 94.

The ion mirror shell 92 along with the traces 94 and the resistive material 96 can be utilized to create another embodiment of the ion mirror 60 in FIG. 4. The ion mirror shell 64 and the traces 62 of the ion mirror 60 can be replaced by the ion mirror shell 92, the traces 94, and the resistive material 96. The traces 94 and the resistive material 96 can be configured to be functionally equivalent to the traces 62 of the ion mirror 60. In the modified ion mirror 60, the traces 94 and the resistive material 96 will operate to create the electrostatic field gradient needed to redirect an incoming packet of ions.

A similar configuration may be utilized to replace the focus traces 88 of the einzel lens 80 in FIG. 6. Instead of having three focus traces 88, the einzel lens 80 may have resistive material placed between two focus traces in order to manipulate packets of ions. The traces-and-resistive material configuration of FIG. 7 may be used in other optical path devices to generate various electrostatic field gradients.

In addition, the traces-and-resistive material configuration may be modified to create non-conventional electrostatic fields within an optical path device. Instead of having only one area of resistive material, a number of areas of resistive material can be employed. An area of resistive material may be subjected to one or more potential differences supplied by two or more traces. Each area of resistive material would then create a particular electrostatic field. The areas of resistive material could vary in size and shape to create a wide range of electrostatic fields. The electrostatic fields created by the areas of resistive material can then be used in an optical path device to manipulate ions.

What is claimed is:

1. An apparatus for manipulating charged particles comprising:

a flexible substrate having a preselected configuration that forms an interior region for receiving a packet of charged particles; and conductive material affixed to said flexible substrate in an arrangement such that a controlled propagation path of said charged particles through said interior region is defined when an electrical current is passed through said arrangement of conductive material, said arrangement of conductive material being disposed to generate a preselected electrical field in said interior region in response to said electrical current.

2. The apparatus of claim 1 wherein said flexible substrate is shaped to form a hollow conduit having an axis through said interior region, said conductive material being configured to form a plurality of generally parallel traces on a surface of said flexible substrate such that said traces have a common axis with said hollow conduit.

3. The apparatus of claim 2 wherein said hollow conduit and said parallel traces define an ion mirror, said ion mirror having an input aperture such that said controlled propagation path includes ingress and egress of said charged particles through said input aperture.

4. The apparatus of claim 3 further comprising a wire-mesh grid affixed within said hollow conduit such that said wire-mesh grid is orientated on a perpendicular plane with respect to said axis of said hollow conduit.

5. The apparatus of claim 2 wherein said hollow conduit and said parallel traces define a lens, said lens having an input aperture and an output aperture such that said controlled propagation path extends through said hollow conduit, said lens generating said preselected electrical field within said hollow conduit to focus said packet of charged particles.

6. The apparatus of claim 5 wherein said conductive material is further configured to form two conductive sheets on said surface of said hollow conduit, said two conductive sheets being positioned on said surface of said flexible substrate such that said preselected electrical field is generated between said two conductive sheets in response to said electrical current.

7. The apparatus of claim 1 wherein said conductive material includes low resistive material and high resistive material, said high resistive material being electrically connected to said low resistive material such that a voltage drop is created across said high resistive material when said electrical current is applied to said low resistive material, said voltage drop having correlation with said preselected electrical field.

8. The apparatus of claim 7 wherein said resistive materials and said flexible substrate define an ion mirror, said low resistive material and said high resistive material generating said preselected electrical field, said ion mirror having an input aperture such that said controlled propagation path includes ingress and egress of said charged particles through said input aperture.

9. The apparatus of claim 7 wherein said high resistive material is arranged into a plurality of regions on said flexible substrate, each of said regions having a predetermined shape and size to generate a portion of said preselected electrical field, said preselected electrical field being non-uniform throughout said interior region.

10. A system for analyzing ions by determining times of flight comprising:

ion source means for directing a packet of ions along a flight path;

ion manipulation means operatively associated with said ion source means for controlling propagation of said packet of ions, said ion manipulation means positioned along said flight path to receive said ions, said ion manipulation means being a flex circuit having conductive material patterned on a flexible substrate that is configured to manipulate said ions propagating along said flight path; and sensing means located at an end of said flight path for detecting said ions reaching said sensing means.

11. The system of claim 10 wherein said ion manipulation means includes an ion mirror defined by said flexible substrate and said conductive material, said flexible substrate and said conductive material forming a hollow conduit for receiving and reflecting said ions, said conductive material generating an electrostatic field gradient within said hollow conduit.

12. The system of claim 11 wherein said conductive material of said ion mirror is configured into a plurality of generally parallel traces on said conductive material, said plurality of generally parallel traces having a common axis with said hollow conduit.

13. The system of claim 11 wherein said ion mirror includes a back plate and a wire-mesh grid, said back plate and said wire-mesh grid attached to said flexible material to form barriers in said hollow conduit.

14. The system of claim 10 wherein said ion manipulation means includes a lens defined by said flexible substrate and said conductive material, said flexible substrate and said conductive material forming a hollow conduit for passage of said ions through said lens, said conductive material generating an electrostatic field within said hollow conduit to narrow said packet of ions.

15. The system of claim 14 wherein conductive material of said lens is further configured into two conductive sheets on said flexible substrate, said two conductive sheets positioned on said flexible substrate such that said electrostatic field is generated between said two conductive sheets.

16. The system of claim 1resistive maid conductive material includes high resistive material that produces a voltage drop when electrical current is allowed to conduct through said resistive material, said high resistive material generating an electrostatic field when conducting said electrical current.

17. The system of claim 16 wherein said flexible substrate and said high resistive material define an ion mirror, said flexible substrate and said high resistive material forming a hollow conduit for receiving and reflecting said ions, said resistive material generating said electrostatic field within said hollow conduit.

18. The system of claim 16 wherein said high resistive material is configured into a plurality of resistive regions on said flexible substrate, each of said regions having a predetermined shape and size to generate a particular electrical field.

19. A method of fabricating an apparatus for manipulating propagation of ions comprising steps of:

forming a conductive material in a preselected pattern on a flexible substrate; and shaping said flexible substrate along with said conductive material to form a hollow member to receive a packet of ions;

wherein said step of forming said conductive material includes defining a desired ion-manipulating electrical field after said flexible substrate is shaped and an electrical current is applied to said preselected pattern of conductive material.

20. The method of claim 19 further including a step of configuring said conductive material into a plurality of strips on said flexible substrate such that each of said strips forms a closed circuit when shaped into said hollow member.

21. The method of claim 19 further including a step of configuring said conductive material into two conductive sheets on said flexible substrate such that each of said conductive sheets is positioned on opposite sides of said hollow member when shaped.

22. The method of claim 19 wherein said step of forming conductive material includes a step of forming high resistive material and low resistive material in said preselected pattern onto said flexible substrate.

* * * * *